US005184815A

United States Patent [19]

Maddox

[11] Patent Number: 5,184,815

[45] Date of Patent: Feb. 9, 1993

[54] BASEBALL BAT GRIP TRAINING AID AND METHOD FOR USING SAME

[75] Inventor: Garry L. Maddox, Penn Valley, Pa.

[73] Assignee: World Wide Concessions, Inc., Philadelphia, Pa.

[21] Appl. No.: 822,953

[22] Filed: Jan. 21, 1992

[51] Int. Cl.[5] ..... A63B 69/40

[52] U.S. Cl. ..... 273/26 C; 2/161 A

[58] Field of Search ..... 273/18, 67 B, 26 C, 273/68, 2, 23, 24, 119 R, 129 R, DIG. 30, 183 B; 272/160, 161 A; 2/160, 161 A, 159

[56] References Cited

U.S. PATENT DOCUMENTS

| | | | |
|---|---|---|---|
| 2,700,159 | 1/1955 | Van Denburgh . | |
| 3,953,030 | 4/1976 | Muchnick . | |
| 3,999,748 | 12/1976 | Clarke . | |
| 4,040,126 | 8/1977 | Cecil | 2/161 A |
| 4,042,975 | 8/1977 | Elliott . | |
| 4,097,005 | 12/1978 | Hertzel, Jr. | 2/161 A |
| 4,187,557 | 2/1980 | Tombari . | |
| 4,253,660 | 3/1981 | Tiktin | 2/160 |
| 4,453,275 | 6/1984 | Kawada | 2/161 A |
| 4,461,043 | 7/1984 | Lomedico . | |
| 4,590,625 | 5/1986 | Keim | 2/161 A |
| 4,654,895 | 4/1987 | Peters . | |
| 4,657,251 | 4/1987 | Larsen . | |
| 4,665,565 | 5/1987 | Odom . | |
| 4,700,405 | 10/1987 | Sternberg . | |
| 4,796,306 | 1/1989 | Mitchell | 2/161 A |
| 4,805,238 | 2/1989 | Crafts | 2/161 A |
| 4,877,242 | 10/1989 | James | 2/161 A |
| 4,911,433 | 3/1990 | Walker | 2/161 A |

*Primary Examiner*—Theatrice Brown
*Attorney, Agent, or Firm*—William H. Eilberg

[57] ABSTRACT

A batting glove has elongated strips of material located on the finger portions of the glove. The strips include a fastening device, such as a Velcro fastener. The glove is provided with at least three buttons, each of which has a Velcro fastener on one side. Thus, the buttons can be removably attached to the strips, at any desired position along the strips. In using the glove, the player first grasps the bat and finds the optimum position for his or her fingers. Then, the player places three or more fingers on the strips, such that the buttons form a straight line. When the player next grasps the bat, he or she simply adjusts the fingers so that the buttons, previously placed on the strips, are again aligned. In this way, the batter can re-create the optimal finger position. With practice, the player learns to grasp the bat immediately with the optimal position. The invention can be used in other sports, such as golf, in which it is necessary to position the fingers around an elongated object.

13 Claims, 3 Drawing Sheets

FIG. 4
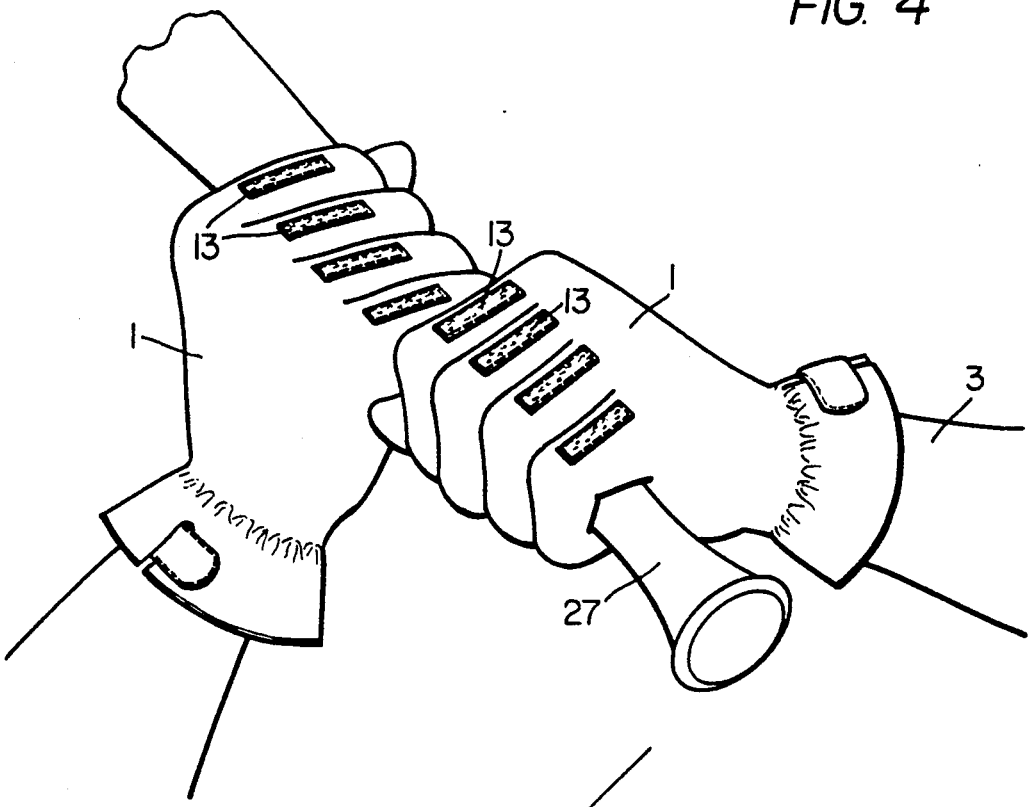
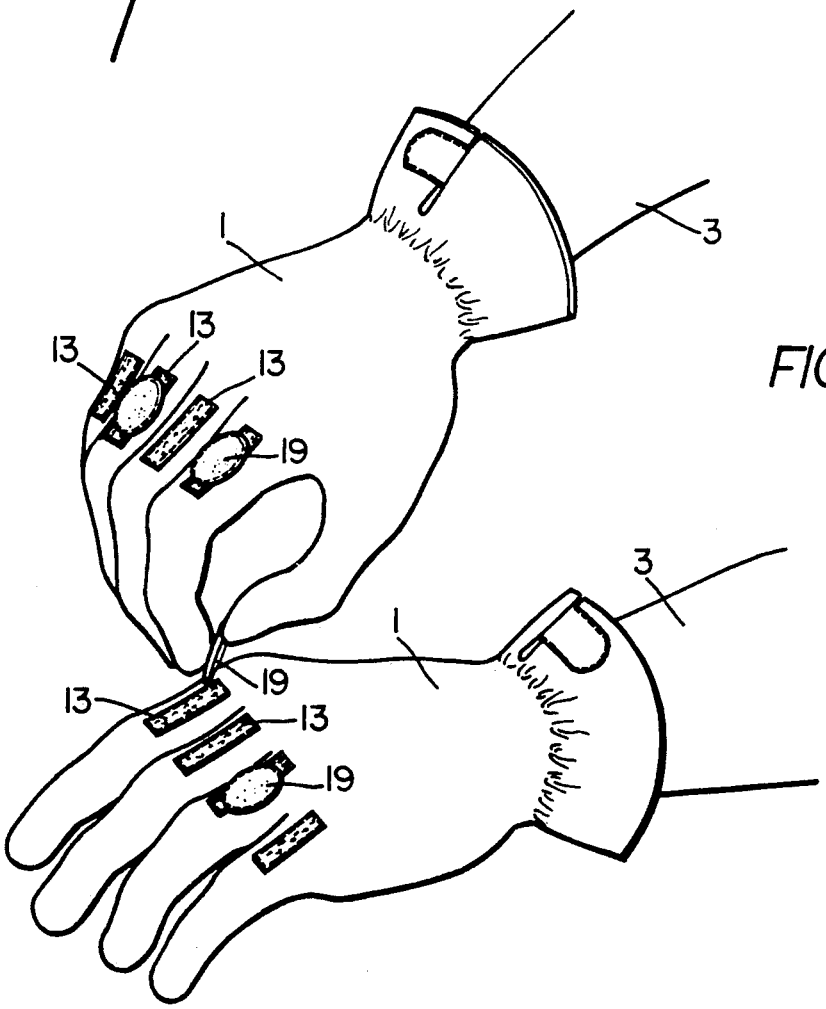
FIG. 5

BASEBALL BAT GRIP TRAINING AID AND METHOD FOR USING SAME

BACKGROUND OF THE INVENTION

This invention relates to a baseball training aid, and a method of using it. In particular, the invention includes a batting glove which is used as a diagnostic and training aid for baseball players.

Various types of gloves, and other devices, have been developed for use in grasping a baseball bat. Some of these devices are intended to be used while playing an actual game, while others are used only for purposes of training players. The following is a brief description of several examples of batting gloves and other batting aids of the prior art.

U.S. Pat. No. 4,187,557 shows a glove which has a pad overlying the second phalange of the finger. The glove is intended for use by baseball players, and enables a batter to increase the force with which the fingers grip the bat.

U.S. Pat. No. 4,700,405 discloses a pair of batting gloves which are used during play, and which are also intended to provide the batter with increased power in hitting the ball.

U.S. Pat. No. 4,042,975 shows a glove which protects a batter from possible injury due to a pitched ball.

U.S. Pat. No. 4,657,251 discloses a training aid and method for baseball players. The patent shows a wristband worn by a batter, the wristband having means for alerting the batter to motions of the wrist, and thus enabling the batter to avoid unwanted motions of the wrist.

U.S. Pat. No. 4,461,043 discloses a batting accessory which includes a cushioning pad which protects the batter's hands, and which also tends to position the bat near the batter's fingertips.

As is explicitly recognized in some of the above-cited patents, the position of the hands relative to a baseball bat is extremely important. The present invention provides a device which assists a player in achieving the proper positioning of the hands relative to the bat, and trains the player to assume the optimum position consistently and easily.

SUMMARY OF THE INVENTION

The present invention includes a glove in which at least two of the finger portions have elongated strips of material disposed along the longitudinal axis of the finger portion. Each strip includes a fastening means, which is preferably a Velcro fastener. The invention further includes a plurality of buttons, the buttons having fastening means, such as Velcro, for attaching the buttons to the strips. Thus, the buttons can be easily attached to and removed from the strips. The buttons can therefore be positioned and repositioned at virtually any location along the strips.

In practicing the method of the present invention, the player puts a glove, of the type described above, on one or both hands. The player adjusts his or her hands until the desired batting position is determined. Then the player (or an assistant or teacher) places a plurality of the above-described buttons on the elongated strips. The player should position the buttons such that they form a generally straight line. The player then puts down the bat, but leaves the buttons affixed to the strips. When the player grasps the bat again, the buttons indicate whether the fingers are in the correct position. In grasping the bat, the player must watch the position of the buttons, and must adjust his or her fingers until the buttons are again arranged in a straight line. After repeated practice, the player learns to assume the correct batting position immediately upon grasping the bat.

It is therefore an object of the invention to provide an aid for training baseball players to hold a bat properly.

It is another object to provide a training method which enables baseball players to learn to hold a bat properly.

It is another object to provide a batting glove which also functions as a training aid.

It is another object to provide a training method which teaches a baseball player to grasp a baseball bat immediately, using the optimum finger position.

Other objects and advantages of the invention will be apparent to those skilled in the art, from a reading of the following brief description of the drawings, the detailed description of the invention, and the appended claims.

BRIEF DESCRIPTION OF THE DRAWINGS

FIG. 4 is a perspective view showing a batter grasping a baseball bat while wearing the batting gloves of the present invention, but before any buttons have been affixed to the gloves.

FIG. 5 is a perspective view showing a batter applying the buttons to the batting glove of the present invention.

DETAILED DESCRIPTION OF THE INVENTION

Figure 1:
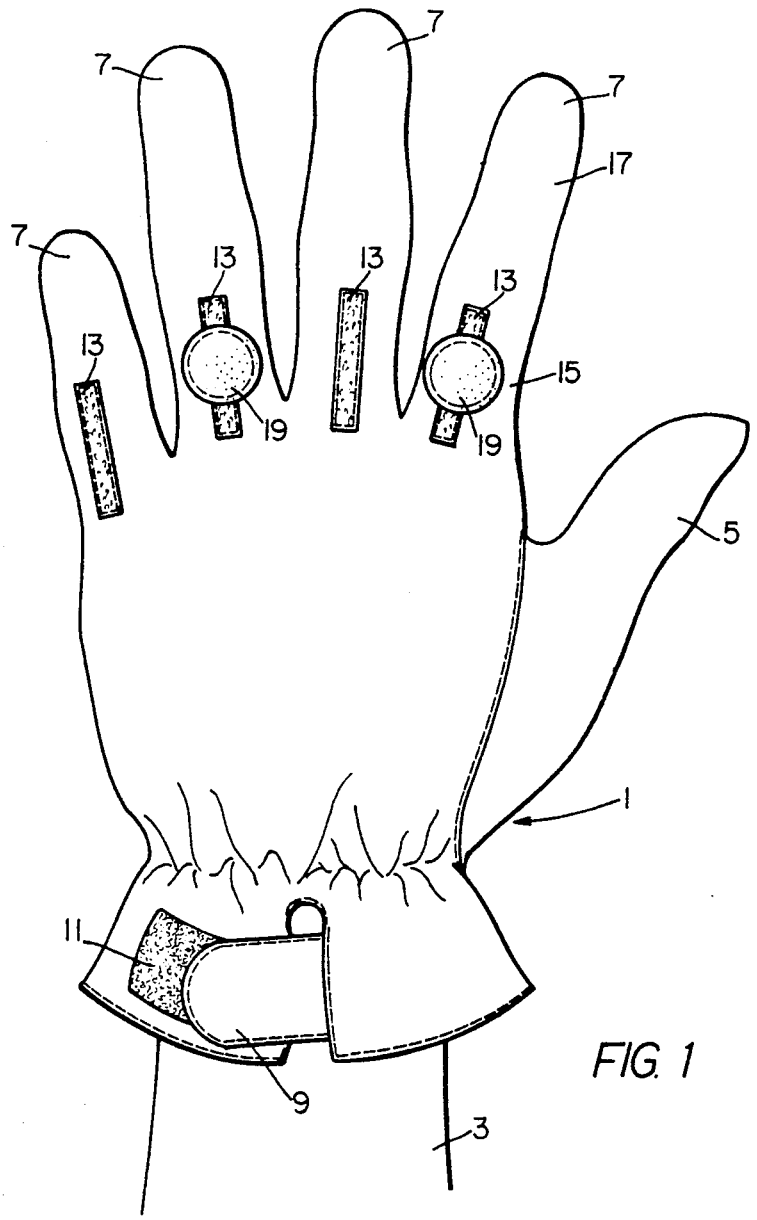
FIG. 1 is a plan view of a batting glove made according to the present invention, the figure showing two buttons attached to elongated strips of fastening material.

FIG. 1 shows the batting glove 1 of the present invention, as it is worn on the hand of a baseball player 3. The glove includes a thumb portion 5 and finger portions 7. Near the wrist area is a flap 9 which is designed to engage fastener 11. Flap 9 and fastener 11 are preferably formed with the hook-and-loop fastening device known by the trademark Velcro. Thus, the position of flap 9 can be varied, causing the glove to fit over the player's hand with an adjustable degree of tightness.

Each finger portion 7 of the batting glove has an elongated strip of material 13. This material is preferably sewn onto the glove, so that one surface of the strip is adjacent to the glove and the other surface is exposed. The strip thus extends along the longitudinal axis of the finger portion. The exposed surface is provided with a fastening material, which in the preferred embodiment, is made of Velcro. The strips are preferably arranged along only the proximal phalanges 15, rather than the distal phalanges 17, although it is possible to provide the strips along the entire length of the finger portions.

Figure 2:
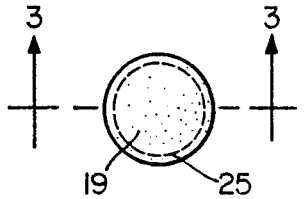
FIG. 2 is a plan view of one of the buttons.
Figure 3:
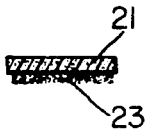
FIG. 3 is a cross-sectional view of the button, taken along the line 3—3 of FIG. 2.

The batting glove further includes a plurality of buttons 19. FIG. 1 shows two such buttons. A typical button is illustrated more plainly in FIG. 2, and in the cross-sectional view of FIG. 3. While the button can assume many different forms, FIGS. 2 and 3 show a button made from a generally circular piece of cloth 21 attached to a piece of Velcro fastening material 23. The material 23 is attached to cloth 21 by stitch line 25. The cloth itself is not intended to be fastened to any other member, and is therefore a different material from the Velcro attached to it.

Due to the presence of Velcro fastening material on both the strips 13 and the buttons 19, the buttons can be easily and removably attached to the strips, at virtually any position along the strips.

FIGS. 4–7 illustrate the use of the batting glove of the present invention. FIG. 4 shows player 3 wearing two batting gloves 1, the gloves being constructed according to the present invention, as described above. The player is grasping a baseball bat 27 with both hands. At the moment represented in FIG. 4, the buttons have not yet been attached to the gloves, and all of the strips 13 are visible. FIG. 4 shows why it is preferable to provide the strips in a location corresponding to the proximal phalanges of the finger: when the player grips the bat as shown in FIG. 4, the proximal phalanges of one hand become arranged in a generally straight line with those of the other hand.

When the player first grasps the bat, as shown in FIG. 4, it is necessary for the player to adjust his or her fingers until the desired and optimal grip is reached. It is assumed that the position shown in FIG. 4 represents the optimal position for the player. The player finds this position by experimentation, or with the aid of a coach or teacher.

FIG. 5 shows the next step, wherein the player places a plurality of buttons 19 on the strips 13. This step can be performed by the player alone, in which case the player must remove one hand from the bat to affix the buttons to the glove on the other hand. Alternatively, the player can remain in position, and the buttons can be affixed by someone else, such as a teacher or coach. The buttons are arranged so that they define a generally straight line. Thus, it is necessary to use at least three buttons. It is possible to apply buttons to each finger of both hands, for a total of eight buttons. It is also possible to use only one glove, and to apply either three or four buttons to that glove. In the preferred embodiment, two gloves are used.

Figure 6:
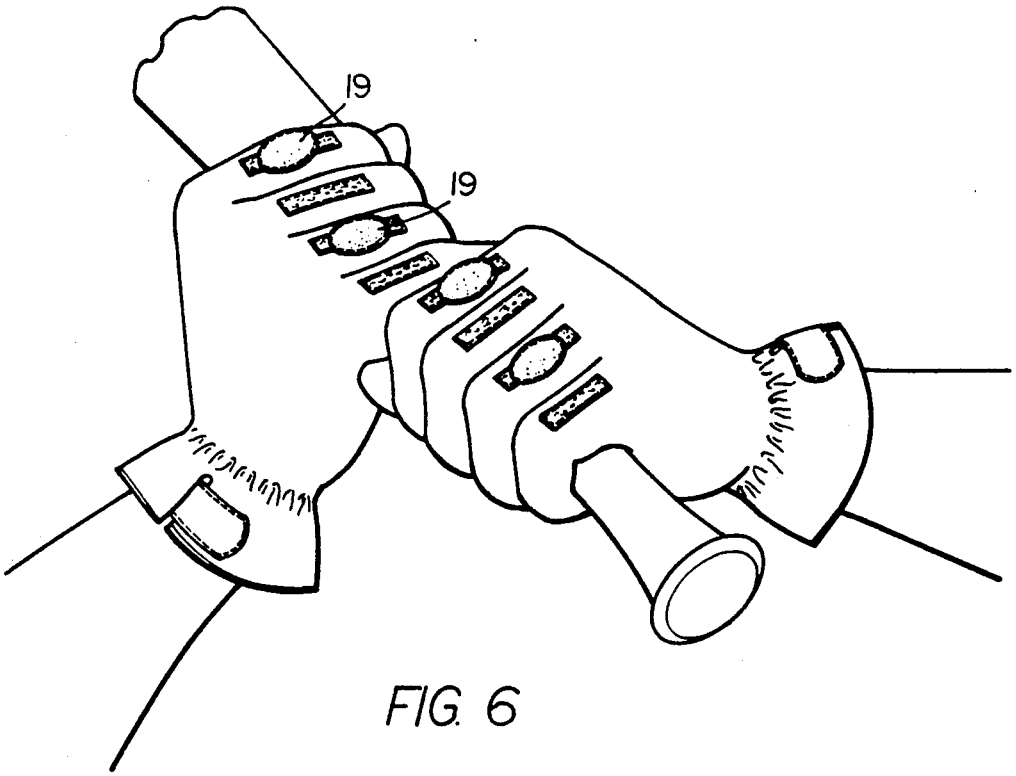
FIG. 6 is a perspective view showing the batter holding the bat, wherein the batter has put the bat down and grasped the bat again, before having readjusted the fingers according to the buttons.
Figure 7:
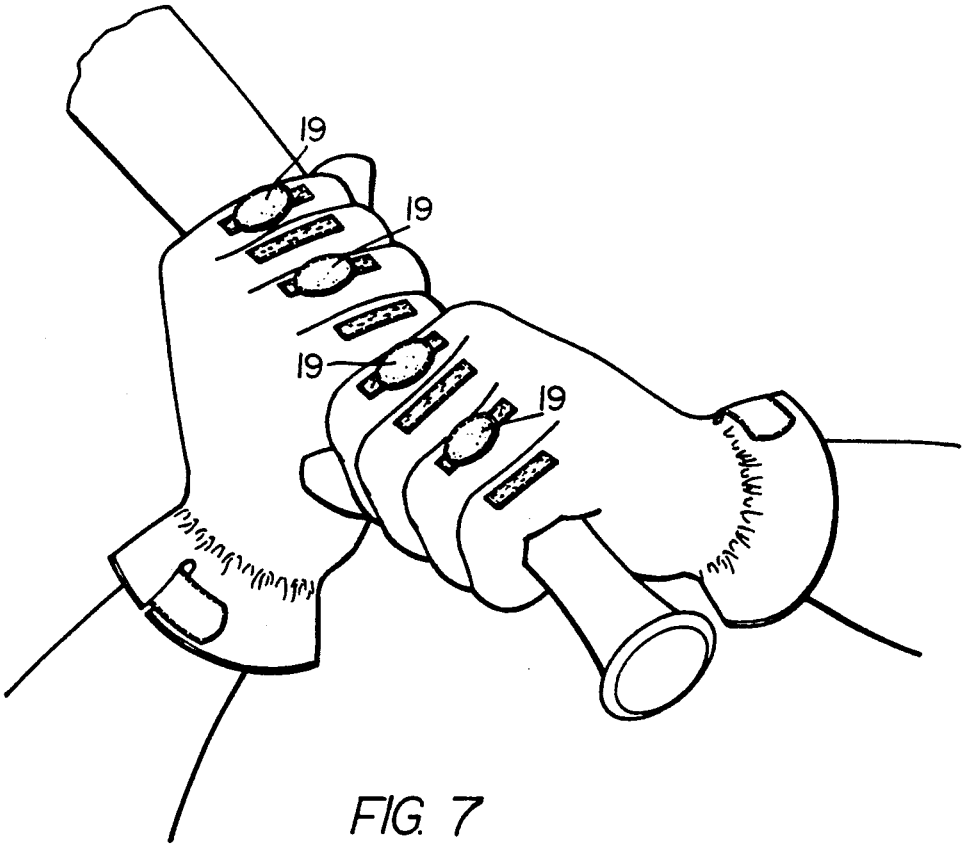
FIG. 7 is a perspective view similar to that of FIG. 6, wherein the batter has adjusted the position of his or her fingers, so as to align the buttons.

After the buttons have been applied, the player lays down the bat, with the buttons in position on the strips. Then, the player grasps the bat again, while wearing the gloves to which the buttons 19 were previously applied. FIG. 6 represents this moment, wherein the player has just begun to grasp the bat again. In FIG. 6, the buttons 19 are not perfectly aligned indicating that the player's fingers are not in the exact position that they assumed in FIG. 4. The player therefore must observe his or her fingers, and must adjust them so that the buttons become arranged in a straight line. FIG. 7 represents the moment when the player has adjusted his or her fingers to achieve the desired position. The buttons 19 have become substantially arranged in a straight line. Thus, the buttons enable the player to reproduce the optimal position found earlier.

After repeated practice, the player will find that it requires very little time to progress from the position shown in FIG. 6 to that shown in FIG. 7. In other words, the player learns to adjust his or her fingers to the optimum position very quickly, by memorizing the "feel" of that position.

Many variations of the invention are possible. The invention is not limited to the use of Velcro fasteners, although Velcro is preferred. Other fastening means, such as adhesives or other fastening devices, could be used instead. The invention is also not limited to the specific structure of the buttons; the buttons need not be round, but could have other shapes. The specific structure of the glove can also be varied.

While the invention is most preferably practiced with two batting gloves, of the type described above, it is possible to use only one glove at one time. In the latter case, the buttons would be affixed only to one hand, and it would be possible to use the invention to position the fingers of one hand only. Thus, various combinations of numbers of gloves and numbers of buttons can be used.

The invention is also not necessarily limited to the field of baseball. The invention can be used in other applications, such as golf, where it is necessary to grip an elongated object, such as a golf club, and wherein the player must learn to position the fingers in a precise manner.

As noted above, it is possible to provide the Velcro strips 13 along the entire length of the finger portions, although the arrangement shown in the figures is preferred. If only one glove is used, it is even possible to provide the Velcro strips on the distal phalanges 17. If only one glove is used, it is necessary to have at least three strips on the glove; if two gloves are used, one glove must have at least one strip and one glove must have at least two strips, so that three buttons can be affixed. Of course, it is preferred that two gloves be used, and that the gloves have four strips each.

The above modifications, and others which will be apparent to those skilled in the art, are intended to be included within the spirit and scope of the following claims.

What is claimed is:

1. A diagnostic and training aid for an athlete, comprising:

a) a glove, the glove having a thumb portion and a plurality of finger portions, each of the finger portions having a longitudinal axis, b) at least two of the finger portions of the glove having elongated, strips of material disposed along the longitudinal axis of the finger portions, each strip having two surfaces, each strip being attached to one of said finger portions along one surface, each strip of material also including fastening means on its other surface, the fastening means extending along the length of the strip, and c) a plurality of buttons, each button having means for engaging the fastening means, at least two of the buttons being affixed to the strips.

2. The training aid of claim 1, wherein the fastening means is removable, wherein the buttons can be repeatedly attached and removed from the strips of material.

3. The training aid of claim 1, wherein the buttons include a first layer made of a material comprising the engaging means, and a second layer made of a different material.

4. A diagnostic and training aid for an athlete, comprising a glove having a thumb portion and finger portions, wherein at least two of the finger portions have an elongated strip of material attached thereto, and at least two buttons, the buttons and the strips having means for removably fastening the buttons to the strips, wherein the buttons can be positioned and repositioned at virtually any location along any of the strips.

5. The training aid of claim 4, wherein the finger portions of the glove define proximal phalanges, and wherein the strips of material are disposed along the proximal phalanges of the finger portions.

6. The training aid of claim 4, wherein the buttons comprise a first layer of material comprising said fastening means, and a second layer of material which is different from said first layer.

7. A method of training a baseball player to hold a bat properly, the method comprising the steps of:

a) placing at least one batting glove on a hand of the player, the batting glove having finger portions, the batting glove including a plurality of strips of material disposed along the finger portions, the strips including fastening means disposed thereon, b) gripping the bat, and determining an optimum position for the player's fingers around the bat, c) placing at least three buttons on said strips, while the player maintains said optimum position, wherein the buttons include means for adhering to said fastening means, wherein the buttons are positioned so that they are arranged in a generally straight line, the buttons being affixed to the strips, d) removing the player's hand from the bat, while allowing the buttons to remain affixed to the strips, and e) gripping the bat again, while moving the player's fingers until the buttons become aligned.

8. The method of claim 7, wherein there are two gloves, placed on both hands of the player in step (a), and wherein steps (d) and (e) are performed for both hands.

9. The method of claim 8 wherein the finger portions define proximal phalanges, and wherein the strips are located along the proximal phalanges.

10. A method of training a baseball player to hold a bat, the method comprising the steps of placing at least one batting glove on a hand of the player, the glove having finger portions which include strips of fastening material disposed thereon, determining an optimum position for the player's fingers around the bat, placing at least three buttons on the strips, the buttons having means for removably affixing the buttons to the strips, the buttons being positioned in a straight line, putting the bat down while keeping the buttons affixed to the strips, grasping the bat again, and moving the player's fingers until the buttons again become arranged in a straight line.

11. The method of claim 10, wherein there are two gloves, placed on both hands of the player.

12. A method of training an athlete to hold an elongated object, the method comprising the steps of placing at least one glove on a hand of the player, the glove having finger portions which include strips of fastening material disposed thereon, determining an optimum position for the player's fingers around the object, placing at least three buttons on the strips, the buttons having means for removably affixing the buttons to the strips, the buttons being positioned in a straight line, putting the object down while keeping the buttons affixed to the strips, grasping the object again, and moving the player's fingers until the buttons again become arranged in a straight line.

13. The method of claim 12, wherein there are two gloves, placed on both hands of the player.

* * * * *